United States Patent [19]

Hertzberg et al.

[11] 4,170,330

[45] Oct. 9, 1979

[54] WEAPONS SYSTEM

[75] Inventors: Abraham Hertzberg, Bellevue; David A. Russell, Kirkland, both of Wash.

[73] Assignee: Mathematical Sciences Northwest, Inc., Bellevue, Wash.

[21] Appl. No.: 460,425

[22] Filed: Apr. 12, 1974

[51] Int. Cl.[2] ..... F42B 15/00

[52] U.S. Cl. ..... 244/3.13

[58] Field of Search ..... 102/105; 244/3.13; 60/205, 218, 265

[56] References Cited

U.S. PATENT DOCUMENTS

| | | | |
|---|---|---|---|
| 3,287,019 | 11/1960 | Arthur | 102/105 X |
| 3,410,502 | 11/1968 | Leadon et al. | 102/105 X |
| 3,489,057 | 1/1970 | Tonkin | 244/3.13 |
| 3,829,047 | 8/1974 | Gonsalves | 244/3.13 |

*Primary Examiner*—Verlin R. Pendegrass
*Attorney, Agent, or Firm*—Graybeal & Uhlir

[57] ABSTRACT

A weapons system is described in which an explosive shell, fired from a cannon or other launch device, is precisely guided to a target to ensure a sure hit and kill capability. A shell having no on-board guidance mechanisms or propulsion devices, but having its tail section coated with a material vaporizable by a laser is employed. A laser beam is directed toward a target, and the shell is fired into the beam toward the target. The vaporization of the coating on the tail of the shell by the laser beam generates forces which, due to the aerodynamic design of the shell and the shaping of the energy distribution within the laser beam, maintain the shell in the path defined by the laser beam to guide the shell into contact with the target.

14 Claims, 6 Drawing Figures

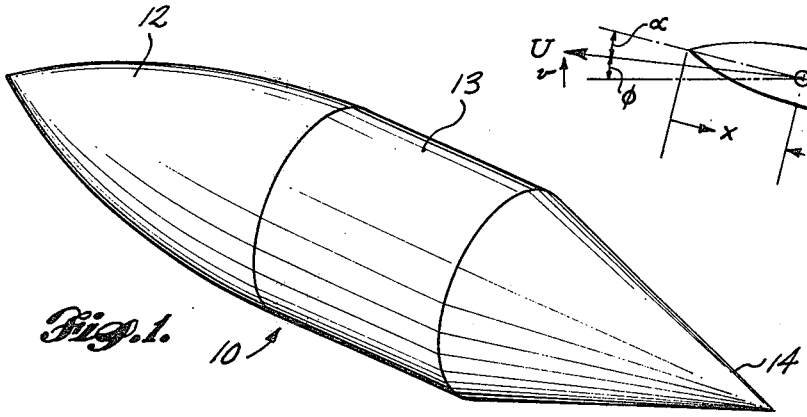
Fig. 1.
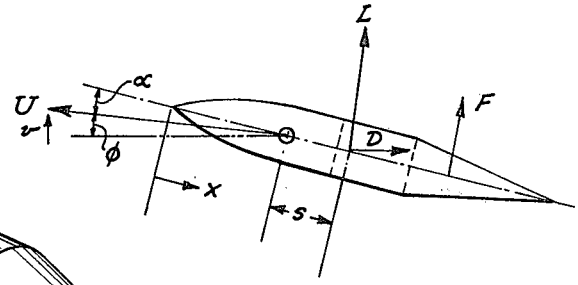
Fig. 6.
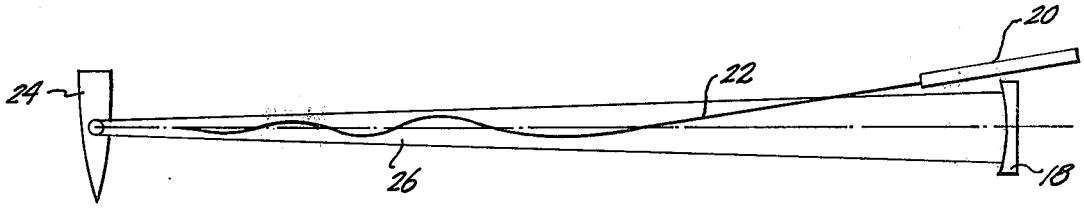
Fig. 3.
Fig. 4.
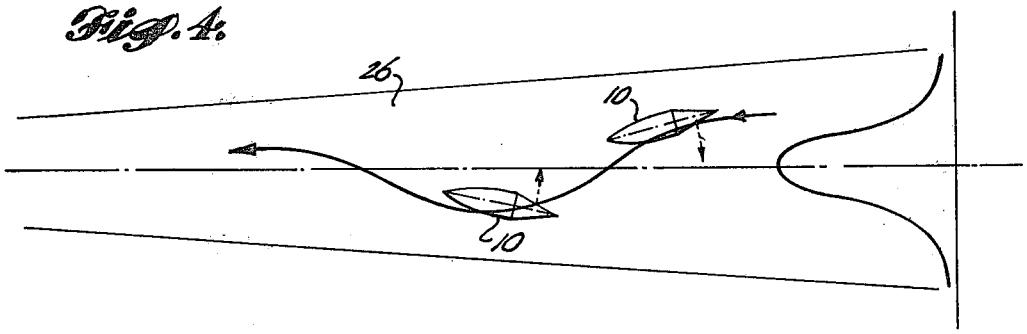
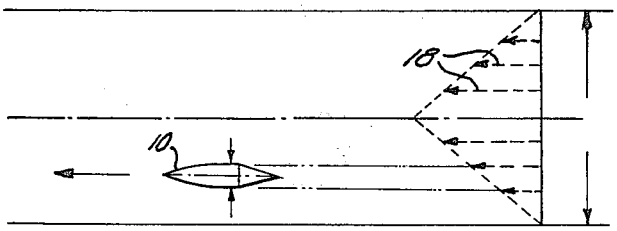
Fig. 2.
Fig. 5.
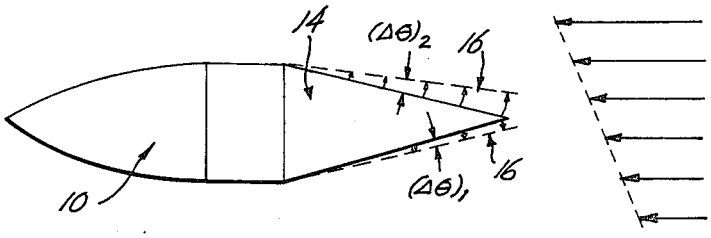

WEAPONS SYSTEM

BACKGROUND OF THE INVENTION

1. Field of the Invention

This invention relates, in general, to weapons systems, and in particular, to a system wherein an explosive shell having no on-board directional guidance mechanisms or propulsions units is guided to a target.

2. Description of the Prior Art

Laser beams are known, as is the concept of employing a laser beam directly to destroy a target. However, although the capability of pointing a laser and tracking moving targets with close to microradian accuracy is available, the high power laser by itself still possesses a limited capability to damage a target due to the necessity of holding the laser continuously on a specific target spot in order to assure the necessary burn capability. On the other hand, most aircraft or missile targets are highly vulnerable to impact with simple explosive shells fired by conventional cannons of various caliber. The missile or aircraft, as the case may be, nonetheless retains a high level of invulnerability due to the unavailability of any weapons system having a high kill capability which employs simple explosive shells. Extremely high capacity weapons, proximity fuses and other techniques have been developed to compensate for the inability to guide a simple explosive shell after it has been fired, but nonetheless, the kill probability of a cannon shell is still regarded as poor in most military operations, and this fact has led to its replacement by various types of guided missiles. Guided missiles involve complex and intricate components and are generally extremely expensive. Laser beams have been used in known systems to guide projectiles, but in all known systems, the projectile itself has included internal guidance systems or infrared receivers and means responsive to particular patterns of radiant energy in the beam directed at the missile capable of converting the energy directed at the missile to electrical impulses which, in turn, activate control rockets, fins, rudders or the like.

BRIEF SUMMARY OF THE INVENTION

By this invention, the best characteristics of the laser and the simplicity of the cannon shell or rocket are combined to provide a relatively inexpensive weapons system having a high hit and kill capability. In one embodiment, an explosive shell or projectile having a stable ballistic shape suitable for high velocity travel, and quite probably having an ogival, conical or pointed nose portion is employed, the tail portion of the shell being coated with a material which is vaporizable by a laser beam directed thereon. The tail portion of the shell may be shaped to maximize the guidance forces generated by vaporization of the coating to maintain the shell within the laser beam. In operation, the laser beam is directed toward a target and maintained thereon, and the explosive shell is fired into the path of the laser beam toward the target such that the laser beam is directed onto the coated tail surfaces of the shell causing the coating to vaporize thus generating forces on the tail of the shell which act in combination with forces generated by the aerodynamic shape of the shell as it travels through the air to maintain the shell within the laser beam.

It is an object of the instant invention, therefore, to provide a weapons system whereby a cannon shell or the like having no on-board guidance devices is guided to a target.

Another object of the instant invention is to provide a weapons system wherein a cannon shell or the like is at least partially coated with a vaporizable material.

Another object of the instant invention is to provide a weapons system wherein a relatively moderate power laser beam is employed to vaporize a coating on the tail portion of a shell to generate forces which assist in maintaining the shell within the laser beam.

One more object is to provide a weapons system wherein an aerodynamically stable explosive shell selectively coated with a radiant energy sensitive material is guided within a laser beam to a target in response to forces on the shell generated by vaporization of portions of the shell coating by the laser beam.

Still another object of the present invention is to provide a weapons system employing an explosive shell with a uniquely shaped tail section which tends to maximize guidance forces generated as a result of radiant energy directed thereon when the shell begins to stray from the laser beam path.

One more object of the instant invention is to provide a weapons system employing a laser beam having cross-sectional rings of varying intensity extending radially outward from its center line.

Still another object of the instant invention is to provide a relatively inexpensive weapons system having high kill probability and reliability factors.

Other and additional objects and advantages will be apparent from the following description taken in conjunction with the accompanying drawings.

BRIEF DESCRIPTION OF THE DRAWINGS

FIG. 1 is a perspective view of one typical shell form suitable for use in accordance with the teachings of the instant invention.

FIG. 2 is a side elevation view of a typical shell configuration made according to the instant invention including a vaporizable coating shown on the tail section of the shell.

FIG. 3 is a schematic diagram illustrating a typical path of travel of a shell within a laser beam directed toward a target according to the instant invention.

FIG. 4 is a schematic diagram showing an explosive shell moving within a laser beam of varying cross-sectional intensity decreasing outwardly from the center of the beam.

FIG. 5 is a schematic diagram similar to FIG. 4 illustrating different levels of laser intensity contacting varying portions of the tail of an explosive shell.

FIG. 6 is a schematic diagram illustrating forces acting upon a shell during travel within a laser guide beam toward a target.

DETAILED DESCRIPTION OF THE INVENTION

Referring initially to FIG. 1, one embodiment of an explosive shell 10 suitable for use in the instant invention is disclosed comprising a cannon shell having a high velocity aerodynamically stable shape such as, for example, the simple ogival nose portion 12, cylindrical centerbody 13 and converging tail portion 14. Cylindrical centerbody 13 may be of varying length depending upon the "static margin" of the shell desired as will be discussed more fully hereafter. While tail 14 is illustrated as having a conical or axially symmetric shaped configuration, it will be understood that a variety of tail shapes may be satisfactorily employed in the instant invention. As will be described more completely hereafter, the function of the conical or axially symmetric tail surface is to allow for the production of steering forces which will be perpendicular to the axis of the shell in the appropriate directions to maintain the shell in the beam, and thus it will be understood that other tail configurations presenting a properly oriented tail surface area to the laser beam during flight along the laser beam may also be satisfactorily employed. The angle of convergence of the conical or axially symmetric tail 14 may also be varied depending upon factors such as the intensity of the laser beam, the aerodynamic stability or instability of the nose portion of the shell, or the ease of vaporization of the shell coating again so that the steering forces generated by vaporization of the shell coating are able to maintain the shell within the laser beam.

Alternatively, the projectile could consist of a double set of cruciform airfoils of the delta shape, with the thickness of the airfoils increasing rapidly to the rear. In one embodiment, the shell could be impact-fused and contain several pounds of high explosive. Alternatively, the shell may be proximity fused, particularly when it is to be used against aircraft or missiles with a high maneuvering capability which would increase the target's chance of escaping momentarily from the shell guiding laser beam directed thereon.

According to the instant invention, the tail section of the shell is coated with an easily vaporizable, low sublimation temperature material such as Teflon, Lucite, polyethylene or other similar materials which vaporize copiously with little energy addition. It will be understood, however, that the nature of this coating material may vary depending in part upon the conditions of temperature and stress to which the shell is subjected during firing or launching, as well as upon the power characteristics of the laser beam to be used to guide the shell. The vaporized material generated during shell travel should not be highly ionized, or if ionized should not be so dense as to prevent the laser radiation from easily penetrating to the tail surface of the shell. The thickness of the coating of vaporizable material on the tail of the shell must be sufficient to allow the shell to be guided along its entire trajectory or path of travel to the target, and since the rate of material vaporized or ablated from the tail of the shell will be, for any given material, proportional to the amount of radiation reaching the surface, coating thickness is additionally dependent upon the intensity of the laser beam integrated along the path which the shell is to travel.

Referring additionally to FIG. 2, one possible coating configuration of vaporizing or ablating material 16 is shown positioned on the tail portion 14 of the shell 10. Other coatings of uniform thickness or having different thickness configurations than that illustrated may also be satisfactorily employed.

Referring now to FIG. 3, a typical operational sequence of the instant weapons systems is disclosed. A laser beam generating source 18 of a conventional type such as a carbon dioxide laser of about 1–10 k.w. power output, various examples being the Photon Sources Incorporated's Model No. 1000; United Aircraft Corporation's Model No. PM41 and AVCO-Everett Research Laboratory's Model No. HP-10, is shown generating a laser beam 26. A shell launching means 20, also of a conventional type such as a cannon or other artillery piece, is positioned adjacent the laser beam generating source such that the cannon is adapted to fire a shell into the beam at a small angle illustrated by shell travel path 22 extending from the launch means 20 to a target 24 on which the beam is locked. As described earlier, the laser beam generating means is preferably mounted for rotational and vertical movements so that the beam can track a moving target, and it is contemplated that the shell launching means may also be positioned on the same movable mounting platform to allow the laser beam and the shell launching means to move together to maintain a fixed entry angle for the shell into the beam. As will be discussed more completely hereafter, the motion of the shell within the laser beam as illustrated by shell travel line 22 is oscillatory with the amplitude of the oscillations being damped as the shell travels within the laser beam and approaches the target. In one operational embodiment, the laser can remain locked onto the target and the shell be forced to take a direct straight line approach along the laser beam to the target, although this is not an efficient intercept trajectory and does place a large maneuvering load on the shell which may limit the angular rate of movement in certain circumstances. Alternatively, a crude amount of lead may be used so that a more economical and efficient trajectory can be flown with relatively small corrections necessary for the final intercept.

In still another embodiment, the shell launching means 20 and the laser generating member 18 may be aligned such that the shell is fired through the center of the beam, and such an arrangement reduces the initial oscillatory motion of the shell within the beam. This firing configuration lends itself particularly to use in conjunction with a laser beam having a donut shaped intensity pattern such that the shell is fired directly into the low intensity hole in the center of the beam and is maintained therein by the action of the laser on the shell when it strays therefrom.

Referring now to FIGS. 4 and 5, the motion of the shell within the confines of the laser beam will be more specifically described. While it will be understood that the shell positions shown in FIG. 4 have been greatly exaggerated, analysis indicates that forces necessary to cause a change in the angle of attack of the shell of a fraction of a degree are all that need be applied to the shell to provide a lift force sufficient to ensure a rapid return of a wandering shell to the center line of the beam. Assuming a laser beam intensity distribution which is peaked at the center of the beam as represented by arrows 28 in FIG. 5, such as could be associated with a good mode controlled optical system, and further assuming the aft end of the projectile to be coated with an easily vaporizable material so that a laser of moderate power will cause ablation, it can be seen that if the projectile has aerodynamic stability, it will be directly captured if it is fired into the beam at a relatively small angle as discussed above. If the shell tries to leave the beam the tail segment of the shell nearest to the center of the beam will be exposed to the more energetic part of the beam and will be preferentially vaporized. This will cause a turning moment to the shell in the manner of either a reaction control or virtual elevator effect, turning the shell to produce a lift force which brings the shell back toward the center line of the beam. Any attempt by the shell to escape will automatically result in the return of the shell to the center of the beam whereupon vaporization will take place equally from all the ablating material.

While the shell will have an angle of attack as it traverses the beam, any attempt to leave the beam will produce a restoring moment which will result in a reverse angle being applied so that the lift vector drives the shell back into the beam. Thus it is preferred that the shell used in the instant weapons system be aerodynamically stable to prevent the oscillatory motion of the shell from building up and escaping the beam. Analysis has indicated that the laser energy required to control projectiles of all reasonable sizes, ranging from small automatic weapons to large caliber cannons, can be quite moderate and, for example, approximating one to ten kw. Further, it should be pointed out that when dealing with a laser power distribution such as shown in FIG. 5, high precision beam shape is not necessary and it is only required that the beam have a higher intensity in the center, falling off rapidly toward the edges.

While the above discussion has pertained primarily to shells having a relatively high aerodynamic stability, variations operational scenario are possible including designing the shell to have neutral stability, i.e. virtually a zero static margin (the dimension "S" in FIG. 6 approximating zero) thereby reducing to trivial levels the laser energy required to contact the tail of the shell in order to turn it.

Referring now to FIG. 6, the forces acting upon a shell moving within the confines of a laser beam having an intensity distribution approximated by the conical configuration of FIG. 5 is shown employing the following notation:

$\alpha$ — angle of attack $\phi$ — angle between flight direction and laser beam axis L — Lift D — Drag F — Force due to ablating surface S — Static margin (distance between cp and cg)

l — length of shell

From these forces, the rotational and translational motion of the shell may be represented by the following equation assuming small angles for $\alpha$ and $\phi$ and neglecting gravity and the moment due to drag force.

$$\alpha = \frac{C}{B}\left[1 - e^{-\frac{At}{2}} \cos\sqrt{B - \left(\frac{A}{2}\right)^2}\, t\right]$$

where $$A = \frac{1}{Um}\left(\frac{dL}{d\alpha}\right) B = \left(\frac{dL}{d\alpha}\right)\frac{S}{I} \quad C = \frac{M_L}{I}$$

If the following values are assumed for the typical case, $$U = 2500 \text{ ft/sec } C_{L\alpha} = 2 \text{ rad}^{-1}$$

$$W = mg = 10 \text{ lbs}$$

$$\frac{dL}{d\alpha} = C_{L\alpha}\frac{1}{2}\rho_\infty u_\infty^2 \frac{\pi d^2}{4} = 0.5 \times 10^3$$

$$d = 2.5 \text{ inches}$$

The value of the constant A becomes:

$$A = \frac{0.5 \times 10^3 (30)}{2.5 \times 10^3 (10)} = 0.60$$

For evaluating constant B, we assume:

S/l= normalized static margin, $I = mr^2$, $r = l/4$

Hence for l=1 ft, the value of B becomes, $$B = \frac{5 \times 10^2}{2 \times 10^{-2}} 2.5 \times 10^4 \frac{S}{l}$$

For $S/l \pm \frac{1}{4}$, note that $B >> (A/2)^2$. The solution for the above angle of attack equation, can then be simplified to:

$$\alpha = \frac{C}{B}\left[1 - e^{-\frac{At}{2}} \cos\sqrt{B}\, t\right]$$

Since the ablation of material on the aft portion of the shell will effectively change the body contour thereof as shown in FIG. 2, and since the laser intensity is greater on the upper surface of the tail section, more material will be ablated there than on the lower surface. The net increase in body slope will then be:

$$\Delta\theta = \Delta\theta_2 - \Delta\theta_1$$

This will give rise to a differential pressure, as evaluated from thin airfoil theory as:

$$\frac{\Delta p}{p} = \frac{\gamma M_\infty{}^2}{\sqrt{M^2 - 1}}\Delta\theta$$

The corresponding moment due to this action is $$M_L = \frac{\gamma M_\infty{}^2}{\sqrt{M_\infty{}^2 - 1}}\Delta\theta p_\infty A_p c$$

where Ap is the area being ablated and c is the distance from the centroid of this area to the cg of the shell.

Using the following values for physical dimension and free-stream conditions, $$u = 2500 \text{ l/sec or } M \cong 2 \quad A_p = d\frac{l}{2} = \frac{l}{4}\ \frac{l}{2} = \frac{l^2}{8}$$

$$C = \frac{l}{2} \quad l = 1 \text{ ft} \quad p_\infty = 2000 \text{ lbs/ft}^3$$

The value of $M_L$ is thus:

$$M_L = 5.0 \times 10^2 \Delta\theta$$

Thus the value of the constant C becomes $$C = \frac{M_L}{I} = \frac{5.0 \times 10^2\,\Delta\theta}{2 \times 10^{-2}} = 2.5 \times 10^4\,\Delta\theta$$

and $$\frac{C}{B} = \frac{2.5 \times 10^4\,\Delta\theta}{2.5 \times 10\ S/L} = \frac{\Delta\theta}{S/l}$$

The equation for angle of attack can now be written as:

$$\alpha = \frac{\Delta\theta}{S/I}\,[1 - e^{-0.3t}\cos 80\,t]$$

And thus the motion of the shell within the laser beam is oscillatory with a damping factor of $e^{-0.3t}$. The period of the oscillation is $$T = 2\pi/80 = 0.075 \text{ sec}$$

and, under the chosen condition the time to damp to ½ amplitude is $$t_{\frac{1}{2}} = ln2/0.3 \cong 2 \text{ sec}$$

The invention may be embodied in other specific forms without departing from the spirit or central characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore to be embraced therein.

What is claimed is:

1. A weapons system comprising:

a shell having a high velocity aerodynamic shape including an axially symmetric rear portion;

a coating on said axially symmetric rear portion of said shell composed of a material easily vaporizable by a low power laser beam;

means generating a low power laser beam;

means directing said laser beam onto a target; and means projecting said shell into said laser beam toward said target whereby said beam controls said shell and guides it to said target by means of forces acting directly on said shell produced by preferential vaporization of said coating.

2. A weapons system comprising:

a laser beam directable toward a target;

an explosive shell adapted to be fired by conventional means into said laser beam toward said target, said shell being aerodynamically shaped such that it tends to maintain a single end forward as it flies toward said target; and a coating on the tail portion of said shell of a material vaporizable by said laser to generate forces tending to maintain said shell in said laser beam.

3. The weapons system of claim 2 wherein said laser beam is circular in cross-section and has a diameter substantially greater than the diameter of said shell.

4. The weapons system of claim 2 wherein said laser beam is circular in cross-section and includes circular areas of varying intensity spaced radially outward from its center.

5. The weapons system of claim 4 wherein said laser beam is of greatest intensity at its center and diminishes progressively outwardly therefrom.

6. The weapons system of claim 4 wherein said laser beam is of greatest intensity at its periphery and diminishes progressively inwardly therefrom.

7. The weapons system of claim 2 wherein said laser beam has a donut shaped cross-section which tends to maintain the flight path of said shell within the central hole portion of said beam.

8. The weapons system of claim 2 wherein said explosive shell includes an ogival nose portion aerodynamically shaped for high velocity travel and a conical converging tail portion coated with said vaporizable material.

9. The weapons system of claim 8 wherein said explosive shell includes a cylindrical body portion between said nose and tail portions.

10. The weapons system of claim 8 wherein said explosive shell is adapted to be cannon fired by means of a discardable sabot system.

11. The weapons system of claim 2 wherein said rear portion of said shell is coated with a solid propellant rocket fuel.

12. Apparatus for directing an explosive shell to a target comprising:

laser beam generation means and means directing said laser beam toward a target;

explosive shell means including an ogival nose portion aerodynamically shaped for high velocity travel and an axially symmetric tail portion coated with a material vaporizable by said laser beam; and means propelling said shell into said laser beam toward said target whereby said coating on the rear portion of said shell is preferentially vaporized responsive to the position of said shell in said laser to produce vaporization forces maintaining said shell within said beam without the assistance of any active guidance means on board said shell.

13. The method of guiding a shell to a target comprising the steps of:

coating the tail surface of an explosive shell with a material vaporizable by a laser beam;

directing a laser beam onto a target;

firing said shell into said laser beam toward said target; and vaporizing portions of said coating on the tail of said explosive shell to generate forces tending to maintain said shell within said laser beam such that said shell contacts said target.

14. The method of claim 13 including the step of forming said shell to have an ogival nose portion and an axially symmetric tail portion.

* * * * *